US011367390B2

(12) United States Patent
Liang et al.

(10) Patent No.: US 11,367,390 B2
(45) Date of Patent: Jun. 21, 2022

(54) DISPLAY APPARATUS AND METHOD FOR NOISE REDUCTION

(71) Applicant: Novatek Microelectronics Corp., Hsinchu (TW)

(72) Inventors: Keko-Chun Liang, Hsinchu (TW); Yu-Hsiang Wang, Hsinchu (TW); Jhih-Siou Cheng, New Taipei (TW); Yi-Chuan Liu, Hsinchu County (TW); Ju-Lin Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 79 days.

(21) Appl. No.: 16/429,049

(22) Filed: Jun. 2, 2019

(65) Prior Publication Data

US 2020/0202776 A1 Jun. 25, 2020

Related U.S. Application Data

(60) Provisional application No. 62/784,688, filed on Dec. 24, 2018.

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0413* (2013.01);
(Continued)

(58) Field of Classification Search
CPC ..... G06F 3/0418; G06F 3/047; G06F 3/044; G09G 3/3648; H01L 27/3244
See application file for complete search history.

(56) References Cited

U.S. PATENT DOCUMENTS 9,830,018 B2 11/2017 Lu et al.
10,156,942 B2 12/2018 Zhao et al.
(Continued)

FOREIGN PATENT DOCUMENTS

CN 101288335 10/2008
CN 104281352 1/2015
(Continued)

OTHER PUBLICATIONS

"Office Action of Taiwan Counterpart Application", dated Mar. 11, 2020, p. 1-p. 6.
(Continued)

*Primary Examiner* — Stephen T. Reed
(74) *Attorney, Agent, or Firm* — JCIPRNET

(57) ABSTRACT

A display apparatus and a method for noise reduction are introduced. The method comprises steps of sensing a first pixel signal being superimposed by noises from a first pixel through a first sensing line in a first phase of a sensing operation and sensing a first noise signal from the first sensing line in a second phase of the sensing operation. The method further comprises steps of sensing a second noise signal from a second sensing line in the first phase of the sensing operation, and sensing a third noise signal from the second sensing line in the second phase of the sensing operation. The method further removes the noises that are superimposed to the first pixel signal according to a difference between the first pixel signal and the first noise signal and a difference between the second noise signal and the third noise signal to generate a denoised sensing value of the first pixel.

14 Claims, 13 Drawing Sheets

(52) U.S. Cl.
CPC . *G09G 2320/0295* (2013.01); *G09G 2330/08* (2013.01); *G09G 2330/12* (2013.01)

(56) References Cited

U.S. PATENT DOCUMENTS

| | | | | |
|---|---|---|---|---|
| 10,185,447 | B2 | 1/2019 | Lin et al. | |
| 10,337,861 | B2 | 7/2019 | Wang | |
| 10,705,654 | B2 | 7/2020 | Kim et al. | |
| 2007/0018932 | A1* | 1/2007 | Takaki | G09G 3/3648 345/98 |
| 2007/0047743 | A1 | 3/2007 | Taenzer et al. | |
| 2008/0129898 | A1* | 6/2008 | Moon | G06F 3/0418 349/12 |
| 2016/0195956 | A1 | 7/2016 | Zhao et al. | |
| 2016/0239974 | A1 | 8/2016 | Wang | |
| 2016/0313845 | A1* | 10/2016 | Lin | G06F 3/04182 |
| 2017/0131838 | A1* | 5/2017 | Lu | G06F 3/047 |
| 2017/0364191 | A1 | 12/2017 | Jiang et al. | |
| 2018/0046325 | A1* | 2/2018 | Kim | G06F 3/0418 |
| 2018/0114815 | A1* | 4/2018 | Lee | H01L 27/3244 |
| 2018/0188888 | A1* | 7/2018 | Hosur | G06F 3/044 |
| 2019/0221146 | A1* | 7/2019 | Lin | G09G 3/3648 |

FOREIGN PATENT DOCUMENTS

| | | |
|---|---|---|
| CN | 105898281 | 8/2016 |
| CN | 107728832 | 2/2018 |
| CN | 107949824 | 4/2018 |
| TW | 201638736 | 11/2016 |
| TW | 201716946 | 5/2017 |

OTHER PUBLICATIONS

Office Action of China Counterpart Application, dated Jun. 21, 2021, pp. 1-8.

* cited by examiner

DISPLAY APPARATUS AND METHOD FOR NOISE REDUCTION

CROSS-REFERENCE TO RELATED APPLICATION

This application claims the priority benefit of U.S. provisional application Ser. No. 62/784,688, filed on Dec. 24, 2018. The entirety of the above-mentioned patent application is hereby incorporated by reference herein and made a part of this specification.

BACKGROUND

Technical Field

The disclosure generally relates to a display apparatus, and more particularly relates to a display apparatus and a method thereof that are capable of removing noises superimposed to a sensing signal quickly and efficiently.

Description of Related Art

In a display system, sensing signals from a display may be superimposed by noises such as power noises, thermal noises, or noises caused by leakage currents. The sensing signals that are superimposed by noises may cause adversely influence to the subsequent processes, and eventually causes undesirable effects to the display system.

As demand for better performance and the faster processing speed for a display system has grown recently, there has grown a need for a more creative technique to efficiently and quickly remove noises from the sensing signal.

Nothing herein should be construed as an admission of knowledge in the prior art of any portion of the present disclosure.

SUMMARY

A display apparatus and a method thereof that are capable of removing noises superimposed to a sensing signal quickly and efficiently are introduced.

In an embodiment of the disclosure, a method for noise reduction comprises steps of sensing a first pixel signal being superimposed by noises from a first pixel through a first sensing line in a first phase of a sensing operation; sensing a first noise signal from the first sensing line in a second phase of the sensing operation; sensing a second noise signal from a second sensing line in the first phase of the sensing operation; sensing a third noise signal from the second sensing line in the second phase of the sensing operation; and removing the noises that are superimposed to the first pixel signal according to a difference between the first pixel signal and the first noise signal and a difference between the second noise signal and the third noise signal to generate a denoised sensing value of the first pixel.

In an embodiment of the disclosure, a display apparatus includes a sensing circuit and a control device. The sensing circuit is configured to sense a first pixel signal being superimposed by noises from a first pixel through a first sensing line in a first phase of a sensing operation, sense a first noise signal from the first sensing line in a second phase of the sensing operation, sense a second noise signal from a second sensing line in the first phase of the sensing operation, and sense a third noise signal from the second sensing line in the second phase of the sensing operation. The control device is configured to remove noises that are superimposed to the first pixel signal according to a difference between the first pixel signal and the first noise signal and a difference between the second noise signal and the third noise signal to generate a denoised sensing value of the first pixel.

In an embodiment of the disclosure, a method for noise reduction comprises steps of sensing m-1 pixel signals being superimposed by noises from m-1 sensing lines among a group of m sensing lines in each of n phases of a sensing operation, wherein m and n are natural numbers, sensing a noise signal from a remaining sensing line of the group of m sensing lines in each of the n phases of the sensing operation; and for each of the n phases, removing noises from each of the m-1 pixel signals according to a different between each of the m-1 pixel signals and the noise signal to generate a denoised sensing value for each of the m-1 sensing lines.

To make the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

It is to be understood that other embodiments may be utilized and structural changes may be made without departing from the scope of the present disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
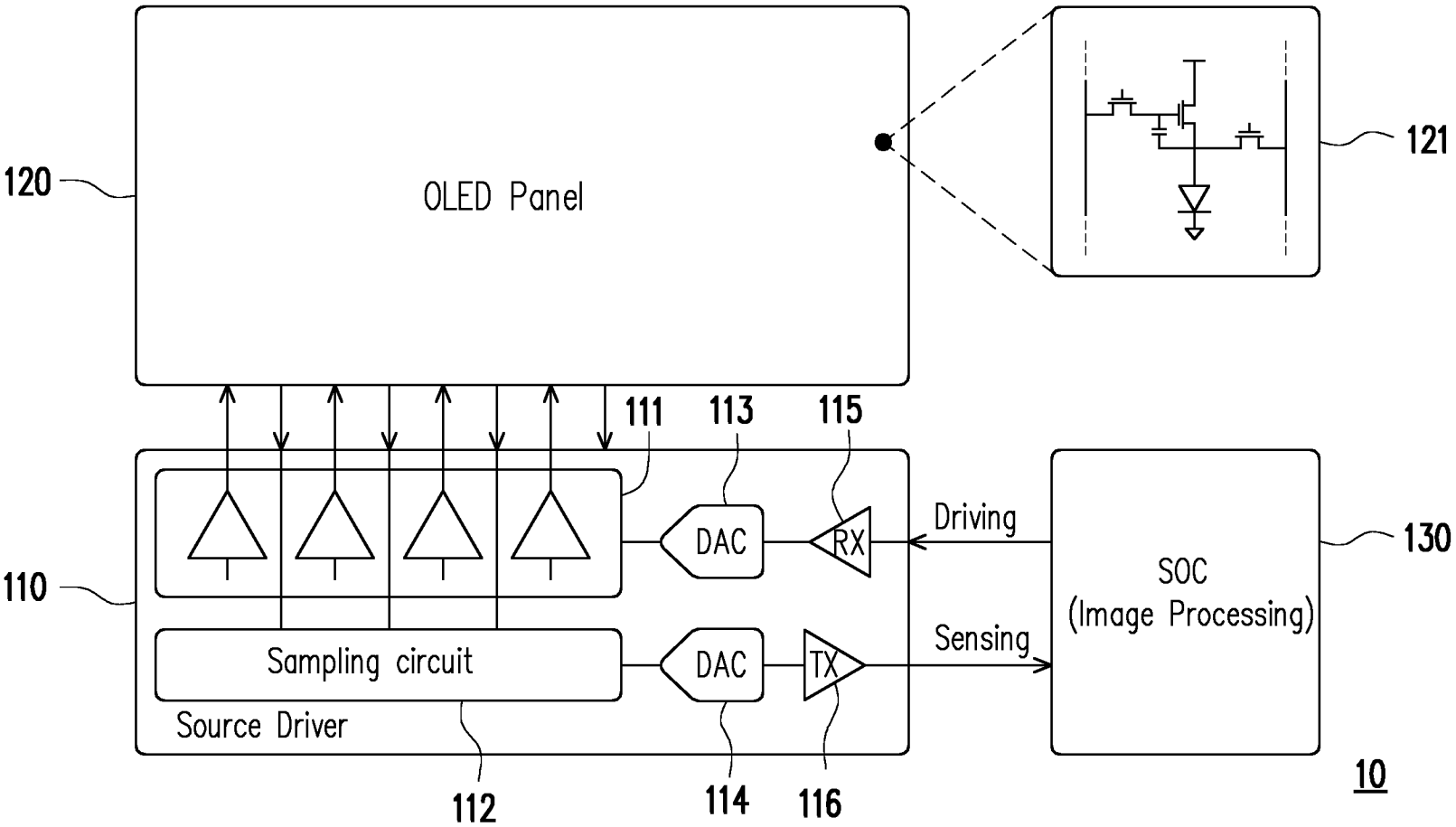
FIG. 1 is a schematic diagram illustrating a display apparatus according to an embodiment of the disclosure.

Referring to FIG. 1, a display apparatus 100 in accordance with an embodiment of the disclosure is illustrated. The display apparatus 100 includes a source driver 110, a display panel 120 and an image processing circuit 130. The display panel 120 includes a plurality of pixels 121 that are configured to display image data. In an embodiment, the display panel 120 is an organic light-emitting diode (OLED) display panel, but the disclosure is not limited thereto. The display panel 120 could be a liquid crystal display (LCD) panel or any other type of display.

The source driver 110 may include different circuits for driving the display panel 120 and sending signals from the display panel 120. For example, the source driver 110 includes a receiver 115, a digital-to-analog converter (DAC) 113, and a buffering circuit 111, where the receiver 115 is configured to receive display data from the image processing circuit 130; the DAC 113 is configured to convert the received display data to analog display signals, and the buffering circuit 111 is configured to output the analog display signal to the display panel 120. The source driver 110 further includes a sampling circuit 112, an analog-to-digital converter (ADC) 114, and a transmitter 116. The sampling circuit 112 is configured to perform a sensing operation to generate sensing signals; the ADC 114 may convert the sensing signals to digital format, and the transmitter 116 outputs the signals to the image processing circuit 130. In some embodiments, the sampling circuit 112 is further configured to perform a sampling operation to signals received from the display panel 120.

The image processing circuit 130 is configured to perform image processing operations to output display data to the source driver 110, and receive signals transmitted from the source driver 110. Electronic components of the image processing circuit 130 may be integrated to an integrated circuit (e.g., System on chip).

Figure 2:
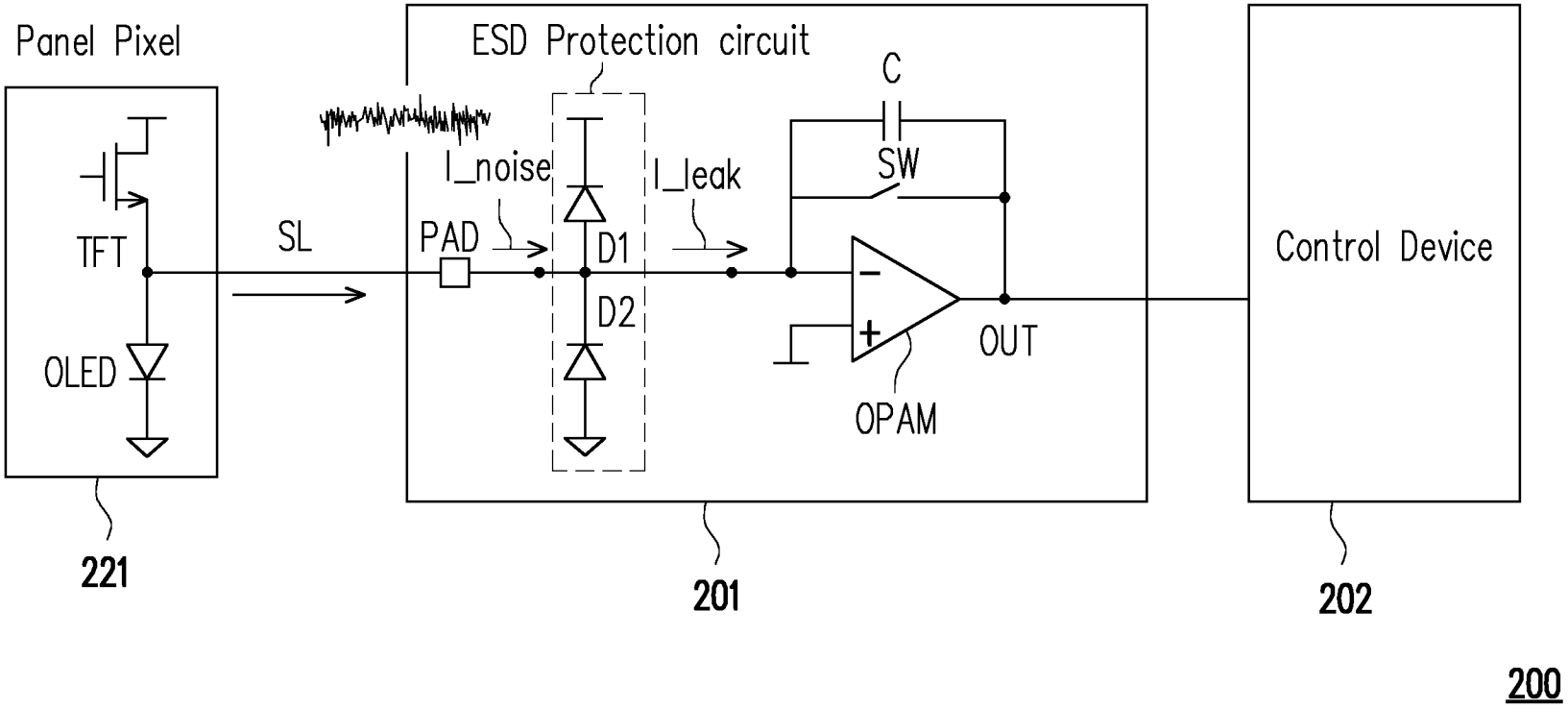
FIG. 2 is a schematic diagram illustrating a sensing circuit and a control device of a display apparatus according to an embodiment of the disclosure.

Referring to FIG. 2, a display apparatus 200 including a sensing circuit 201 and a control device 202 in accordance with an embodiment of the disclosure is illustrated. In an embodiment, the sensing circuit 201 may be included in the sampling circuit (e.g., sampling circuit 112 shown in FIG. 1) of the source driver (e.g., the source driver 110 shown in FIG. 1). The sensing circuit 201 is configured to senses electrical values (e.g., currents or voltages) from pixels of the display panel. For example, the sensing circuit 201 may sense a pixel current I_OLED flowing through the OLED of the pixel 221, and output an output a signal OUT that indicates the pixel current I_OLED to the control device 202. The sensing current I_OLED is usually superimposed by the noise current I noise and leakage current I leak that are existed in the sensing line SL. Therefore, the output signal OUT includes the noises caused by the noise current I_noise and the leakage current I_leak. The signal OUT may be a voltage signal that corresponds to the pixel current I_OLED being superimposed by the noise current I_noise and leakage current I_leak.

In an embodiment, the sensing circuit 201 may include an electrostatic discharge (ESD) protection circuit to protect the sensing circuit 201 and subsequent circuits from electrostatic discharge. As an example shown in FIG. 2, the ESD protection circuit may be formed by two diodes D1 and D2. The sensing circuit 201 may further include an operational amplifier OPAM, a reset switch SW and an integration capacitor C. The operational amplifier OPAM has an inverting input terminal coupled to the sensing line, a non-inverting input terminal coupled to receive a reference voltage, and an output terminal to output the signal OUT to the control device. The reset switch SW are coupled in parallel to the integration capacitor C, and the reset switch SW and the integration capacitor C are coupled between the non-inverting input terminal and the output terminal of the operational amplifier OPAM. The reset switch SW and an integration capacitor C are controlled to perform a reset operation and an integration operation during the operation of the sensing circuit 201.

In an embodiment of the disclosure, the sensing circuit 201 is configured to sense currents flowing through the sensing line SL in different phases. For example, in one phase when the pixel is turned on, the sensing circuit 201 may sense the current from the pixel 221 through the sensing line SL; while in another phase when the pixel is turned off, the sensing circuit 201 may sense the noise current and leak current in the sensing line SL.

The control device 202 receives the signal OUT from the sensing circuit 201 and is configured to remove noises caused by the noise current I_noise and the leakage current I_leak that are superimposed to the pixel current I_OLED. In an embodiment of the disclosure, the control device 202 could be included in the timing controller (not shown) or the driver integrated circuit or the image processing apparatus (SoC) of the display apparatus 200. However, the disclosure is not limited thereto, and the control device 202 may be located anywhere in the display apparatus 200.

Figure 3:
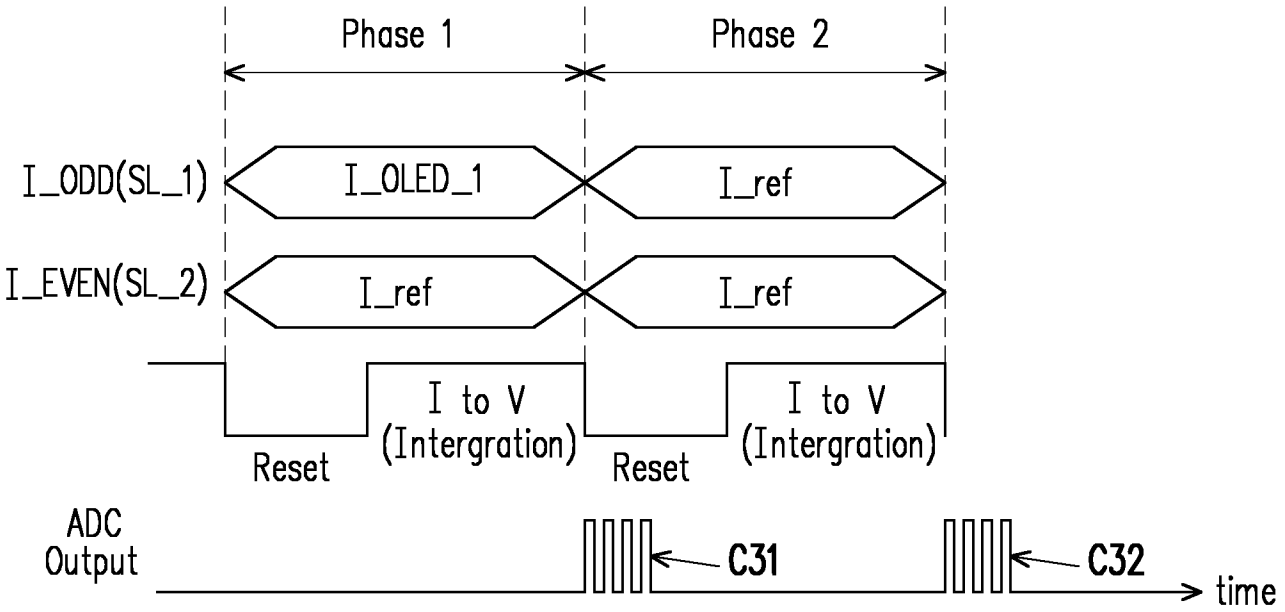
FIG. 3 is a diagram illustrating signals sensed from sensing lines in two phases according to an embodiment of the disclosure.

Referring to FIG. 3, a diagram illustrating current signals I_ODD and I_EVEN sensed from sensing lines SL_1 and SL_2 in two phase 1 and phase 2 in accordance with an embodiment of the disclosure is illustrated. In some embodiments, the two sensing lines SL_1 and SL_2 are two adjacent sensing lines, but the disclosure is not limited thereto. In phase 1 and phase 2, pixel current I_OED_1 indicates a pixel current of a pixel when the pixel is turned on, and the current I_ref indicates of the pixel when the pixel is turned off. Ideally, when the pixel is turned off, no current (e.g., I_ref=0 ampere (or 0 A)) is sensed from the pixel, but the practical value of I_ref may be slightly different from 0 A because of undesired effects. Each of the phase 1 and phase 2 may include a reset operation and an integration operation which are similar to the reset operation and an integration operation of a correlated double sampling (CDS) operation.

Referring to FIG. 3 and Table 1, in the phase 1, a current $I_{A1}$ which includes the pixel current I_OLED_1 and noises (e.g., I_noise1 and 1_leak1) is sensed from the sensing line SL_1, and a noise current $I_{B1}$ is sensed from the sensing line SL_2. As shown in Table 1, the current $I_{A1}$ is represented as I_OLED_1+I_noise1+I_leak1, wherein the I_noise1 and I_leak1 are the noise current and the leak current on the sensing line SL_1 during the phase 1. Also in Table 1, the noise current $I_{B1}$ is represented as I_ref+I_noise1+I_leak2, where the I_ref indicates the current of the pixel when the pixel is turned off; I_noise1 and I_leak2 indicates the noise current and the leakage current of the sensing line SL_2 during the phase 1. The currents $I_{A1}$ and $I_{B1}$ may be converted to the corresponding voltages T/C ($I_{A1}$) and T/C ($I_{B1}$), and the digital code C31 corresponding to the voltages T/C ($I_{A1}$ and T/C ($I_{B1}$) may be outputted by the ADC (e.g., ADC 114 in FIG. 1) at the end of the phase 1.

In the phase 2, the noise currents $I_{C1}$ and $I_{D1}$ are sensed from the sensing lines SL_1 and SL_2, respectively. As shown in Table 1, the noise current $I_{C1}$ is represented as I_ref+I_noise2+I_leak1, where I_noise2 and I_leak1 indicates the noise current and the leakage current of the sensing line SL_1 during the phase 2. The noise current $I_{D1}$ is represented as I_ref+I_noise2+I_leak2, wherein I_noise2 and I_leak2 indicate the noise current and the leakage current of the sensing line SL_2 during the phase 2. The currents $I_{C1}$ and $I_{D1}$ may be converted to the corresponding voltages T/C ($I_{C1}$) and T/C ($I_{D1}$), and the digital code C32 corresponding to the voltages T/C ($I_{C1}$) and T/C ($I_{D1}$) may be outputted by the ADC (e.g., ADC 114 in FIG. 1) at the end of the phase 2.

It should be noted that the noise currents are assumed to be the same for different sensing lines in a same phase; and the leakage currents are assumed to be the same for different phases of the same sensing line. As being illustrated in Table 1, the currents $I_{A1}$ and $I_{B1}$ that are sensed during the phase 1 contain the same noise current I_noise1; and the current $I_{A1}$ an $I_{C1}$ that are sensed from the sensing line SL_1 contain the same leakage current I_leak1.

TABLE 1

| | ADC output voltage during Phase 1 | ADC output voltage during Phase2 |
|---|---|---|
| I_ODD (SL_1) | T/C ($I_{A1}$), $I_{A1}$ = I_OLED_1 + I_noise1 + I_leak1 | T/C ($I_{C1}$), $I_{C1}$ = I_ref + I_noise2 + I_leak1) |
| I_EVEN (SL_2) | T/C ($I_{B1}$), $I_{B1}$ = I_ref + I_noise1 + I_leak2 | T/C ($I_{D1}$), $I_{D1}$ = I_ref + I_noise2 + I_leak2 |

A difference between currents $I_{A1}$ and $I_{B1}$ and a difference between the noise currents $I_{C1}$ and $I_{D1}$ are calculated. For example, the difference between currents $I_{A1}$ and $I_{B1}$ is calculated by ($I_{A1}-I_{B1}$=I_OLED_1+I_leak1−I_ref−I_leak2); and the difference between the noise currents $I_{C1}$ and $I_{D1}$ is calculated by ($I_{C1}-I_{D1}$=I_leak1−I_leak2). Next, a subtraction operation is performed to subtract the difference ($I_{c1}-I_{D1}$) from the difference ($I_{A1}-I_{B1}$). Particularly, the result of the subtraction operation is (I_OLED_1−I_ref). Since the current I_ref is the measured pixel current when the pixel is turned off, the current I_ref is equal to or substantially equal to zero. In this way, the noises that superimposed to the current I_OLED_1 is removed.

Figure 4A:
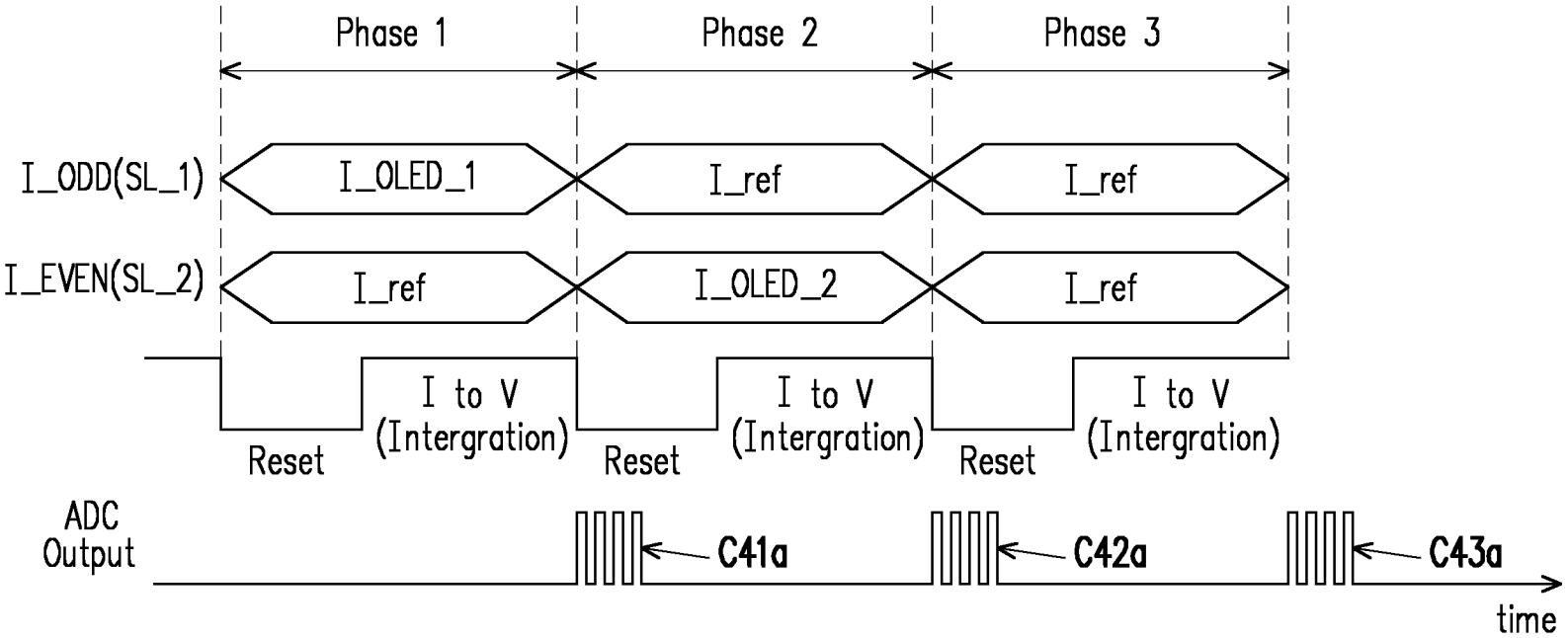
FIG. 4A to FIG. 4B are diagrams illustrating signals sensed from sensing lines in three phases according to some embodiments of the disclosure.

Referring to FIG. 4A and Table 2, in the phase 1, a current $I_{A2}$ (I_OLED_1+I_noise1+I_leak1) that indicates the pixel current I_OLED_1 being superimposed by noises is sensed from the sensing line SL_1, and the noise current $I_{B2}$ (I_ref+I_noise1+I_1eak2) is sensed from the sensing line SL_2. The currents $I_{A2}$ and $I_{B2}$ may be converted to the corresponding voltages T/C ($I_{A2}$) and T/C ($I_{B2}$), and the digital code C41*a* corresponding to the voltages T/C ($I_{A2}$) and T/C ($I_{B2}$) may be outputted by the ADC (e.g., ADC 114 in FIG. 1) at the end of the phase 1.

In the phase 2, a noise current $I_{C2}$ (I_ref+I_noise2+I_leak1) is sensed from the sensing line SL_1, and the current $I_{D2}$ (I_OLED_2+I_noise2+I_leak2) is sensed from the sensing line SL_2. The currents $I_{C2}$ and $I_{D2}$ may be converted to the corresponding voltages T/C ($I_{C2}$) and T/C ($I_{D2}$), and the digital code C42*a* corresponding to the voltages T/C ($I_{C2}$) and T/C ($I_{D2}$) may be outputted by the ADC (e.g., ADC 114 in FIG. 1) at the end of the phase 2.

In the phase 3, a noise current $I_{E2}$ (I_ref+I_noise3+I_leak1) is sensed from the sensing line SL_1 and a noise current $I_{F2}$ (I_ref+I_noise3+I_leak2) is sensed from the sensing line SL_2. The currents $I_{E2}$ and $I_{F2}$ may be converted to the corresponding voltages T/C ($I_{E2}$) and T/C ($I_{F2}$), and the digital code C43*a* corresponding to the voltages T/C ($I_{E2}$) and T/C ($I_{F2}$) may be outputted by the ADC (e.g., ADC 114 in FIG. 1) at the end of the phase 3.

TABLE 2

| | ADC Output Voltage during Phase 1 | ADC Output Voltage during Phase2 | ADC Output Voltage during Phase3 |
|---|---|---|---|
| I_ODD (SL_1) | T/C($I_{A2}$), $I_{A2}$ = I_OLED_1 + I_noise1 + I_leak1 | T/C($I_{C2}$), $I_{C2}$ = I_ref + I_noise2 + I_leak1 | T/C($I_{E2}$) $I_{E2}$ = I_ref + I_noise3 + I_leak1 |
| I_EVEN (SL_2) | T/C($I_{B2}$), $I_{B2}$ = I_ref + I_noise1 + I_leak2 | T/C($I_{D2}$) $I_{D2}$ = I_OLED_2 + I_noise2 + I_leak2 | T/C($I_{F2}$) $I_{F2}$ = I_ref + I_noise3 + I_leak2 |

A difference between currents $I_{A2}$ and $I_{B2}$ and a difference between the noise currents $I_{E2}$ and $I_{F2}$ are calculated. For example, the difference between currents $I_{A2}$ and $I_{B2}$ is calculated by ($I_{A1}-I_{B1}$=I_OLED_1+I_leak1−I_ref−I_leak2); and the difference between the noise currents $I_{E2}$ and $I_{F2}$ is calculated by ($I_{C1}-I_{D1}$=I_leak1−I_leak2). Next, a subtraction operation is performed to subtract the difference ($I_{C1}-I_{D1}$) from the difference ($I_{A1}-I_{B1}$). Particularly, the result of the subtraction operation is I_OLED_1−I_ref. Since the current I_ref is the measured pixel current when the pixel is turned off, the current I_ref is substantially equal to zero. In this way, the noises that superimposed to the current I_OLED_1 is removed.

In addition, a difference between currents $I_{D2}$ and $I_{C2}$ is calculated by ($I_{D2}$-31 $I_{C2}$=I_OLED_1+I_leak1-31 I_ref−I_leak2). Next, a subtraction operation is performed to subtract the difference ($I_{D2}-I_{C2}$) from the difference ($I_{F2}$-$I_{E2}$). Particularly, the result of the subtraction operation is I_OLED_2−I_ref. Since the current I_ref is substantially equal to zero, the noises that superimposed to the current I_OLED_2 is removed, and the value of I_OLED_2 is obtained. In this way, it needs only three phases to remove the noise current and the leakage current from the pixel current I_OLED_1 and I_OLED_2.

Figure 4B:
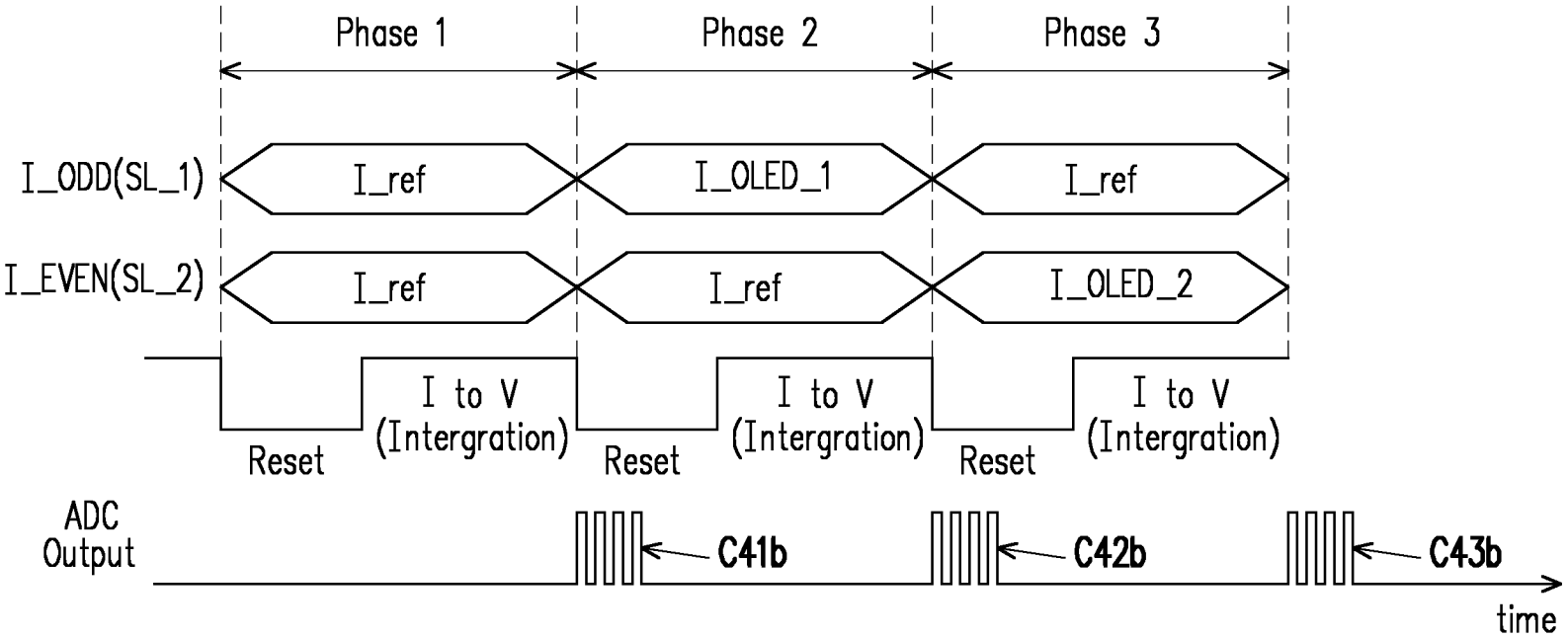

Referring to FIG. 4B and Table 3, the currents $I_{A3}$ and $I_{B3}$ are respectively sensed from the sensing lines SL_1 and SL_2 in phase 1; the currents $I_{C3}$ and $I_D$ are respectively sensed from the sensing lines SL_1 and SL_2 in phase 2; and currents $I_{E3}$ and $I_{F3}$ are respectively sensed from the sensing lines SL_1 and SL_2 in phase 3. The currents $I_{A3}$, $I_{B3}$, $I_{C3}$, $I_{D3}$, $I_{E3}$, $I_{F3}$ may be converted to the corresponding voltages T/C ($I_{A3}$), T/C ($I_{B3}$), T/C ($I_{C3}$), T/C ($I_{D3}$), T/C ($I_{E3}$), T/C ($I_{F3}$), and the digital codes C4*b*, C42*b* and C43C may be outputted by the ADC at the end of the phase 1, phase 2 and phase 3.

The current I_OLED_1 is obtained by performing a subtraction operation to subtract a difference between the currents $I_{A3}$ and $I_{B3}$ ($I_{A3}-I_{B3}$) from a difference between $I_{C3}$ and $I_{D3}$ ($I_{C3}-I_{D3}$). The current I_OLED_2 is obtained by performing a subtraction operation to subtract a difference between the currents $I_{B3}$ and $I_{A3}$ ($I_{B3}$-$I_{A3}$) from a difference between $I_{E3}$ and $I_{F3}$ ($I_{F3}$-$I_{E3}$).

TABLE 3

| | ADC Output Voltage during Phase 1 | ADC Output Voltage during Phase2 | ADC Output Voltage during Phase3 |
|---|---|---|---|
| I_ODD (SL_1) | T/C ($I_{A3}$), $I_{A3}$ = I_ref + I_noise1 + I_leak1 | T/C ($I_{C3}$), $I_{C3}$ = I_OLED_1 + I_noise2 + I_leak1 | T/C($I_{E3}$), $I_{E3}$ = I_noise3 + I_leak1 |
| I_EVEN (SL_2) | T/C ($I_{B3}$), $I_{B3}$ = I_ref + I_noise1 + I_leak2 | T/C ($I_{D3}$), $I_{D3}$ = I_ref + I_noise2 + I_leak2 | T/C($I_{F3}$), $I_{F3}$ = I_OLED_2 + I_noise3 + I_leak2 |

Figure 5:
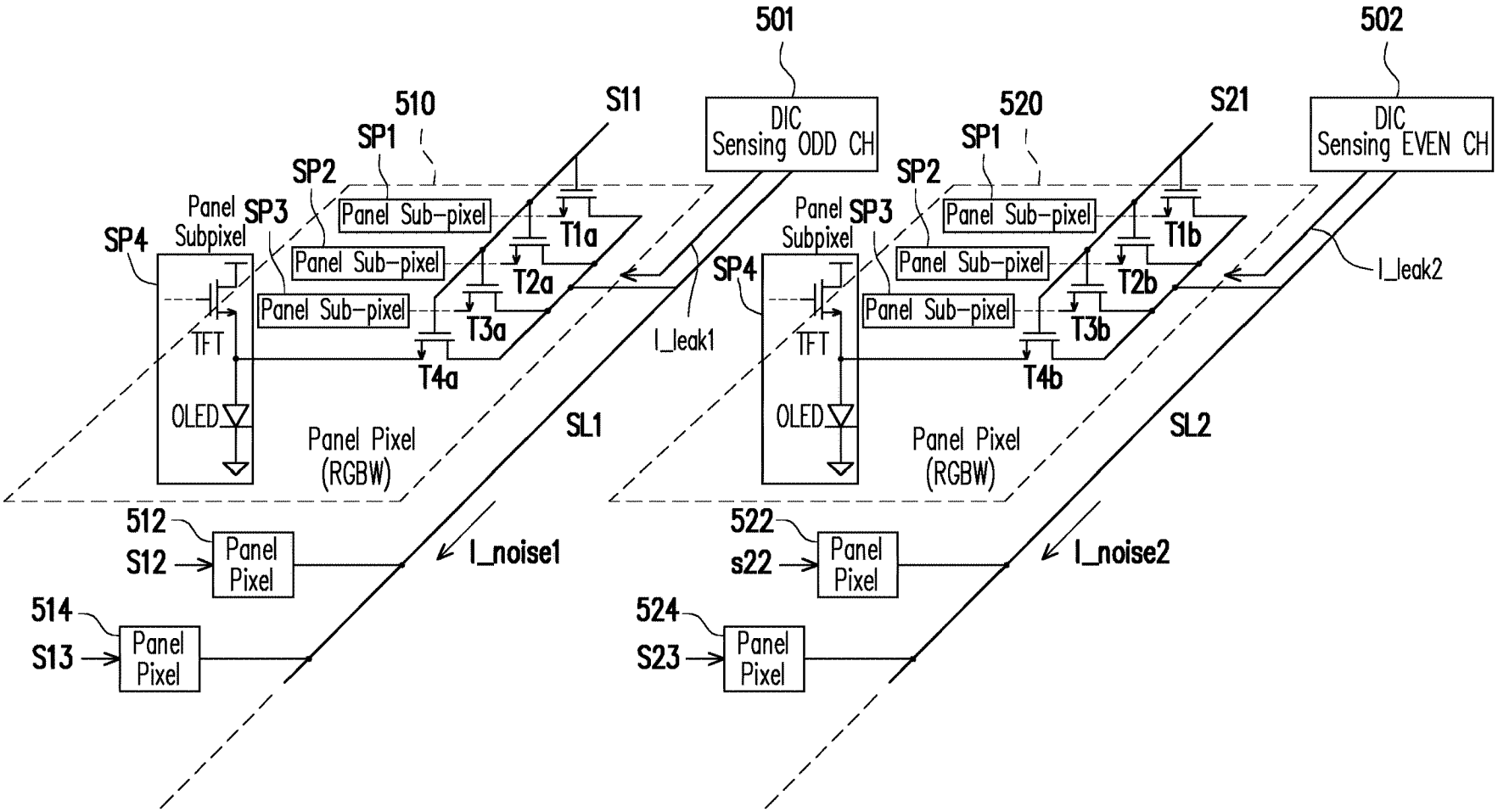
FIG. 5 is a schematic diagram illustrating pixels being coupled to sensing lines according to an embodiment of the disclosure.

Referring to FIG. 5, a schematic diagram illustrating pixels being coupled to sensing lines SL_1 and SL_2 in accordance with an embodiment of the disclosure is illustrated. The sensing lines SL_1 and SL_2 are coupled between pixels of a display panel (not shown) and sensing channels 501 and 503. The pixels 510, 512 and 514 which are coupled to the sensing line SL_1 are controlled by control signals S11, S12 and S13; and the pixels 520, 522 and 524 which are coupled to the sensing line SL_2 are controlled by signal S21, S22 and S23. Each of the pixels 510 and 520 may include a plurality of sub-pixels SP1, SP2, SP3 and SP4. The sub-pixels SP1, SP2, SP3 and SP4 of the pixel 510 are coupled to the sensing lines SL_1 through transistors T1*a*, T2*a*, T3*a* and T4*a*; and the sub-pixels SP1, SP2, SP3 and SP4 of the pixel 520 are coupled to the sensing line SL_2 through transistors T1*b*, T2*b*, T3*b* and T4*b*. The signals in the sensing lines SL_1 and SL_2 may be superimposed by noise signals (e.g., I_noise1 and I_noise2) and leakage signals (e.g., I_leak1 and I_leak2).

Figure 6A:
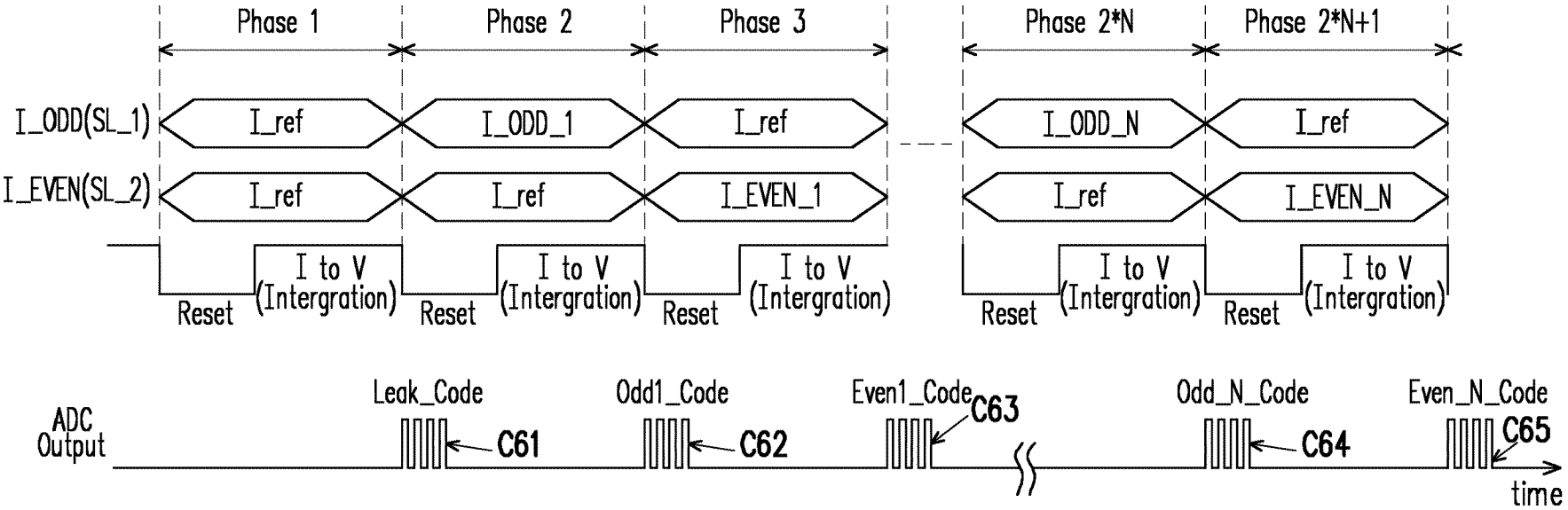
FIG. 6A is a diagram illustrating signals sensed from sensing lines in a plurality of phases according an embodiment of the disclosure.

Referring to FIG. 6A, a diagram illustrating signals sensed from sensing lines SL_1 and SL_2 in a plurality of phases (phase 1 to phase 2*N+1) in accordance with an embodiment of the disclosure is illustrated. IN phase 1, both of the sensing lines SL_1 and SL_2 are configured to sense the noise signals (e.g., noise signal I_noise and leakage signal I_leak) existed in the sensing lines SL_1 and SL_2. During each of the phases (phase 2 to phases 2*N+1), one of the sensing lines SL_1 and SL_2 is used to sense the noise signals (e.g., noise signal I_noise and leakage signal I_leak), and the other sensing line is used to sense a pixel current of a pixel that is coupled to the other sensing line. For example, in the phase 2, the sensing line SL_2 is used to sense the noise signal and the sensing line SL_1 is used to sense a pixel signal (I_ODD_1) of a pixel coupled to the sensing line SL_1. In the phase 2*N+1, the sensing line SL_1 is used to sense the noise signal and the sensing line SL_2 is used to sense a pixel signal (I_EVEN_N) of a pixel coupled to the sensing line SL_2. The ADC (not shown) may output a code (e.g., codes C61, C62, C63, C64, C65) at the end of phases.

Figure 6B:
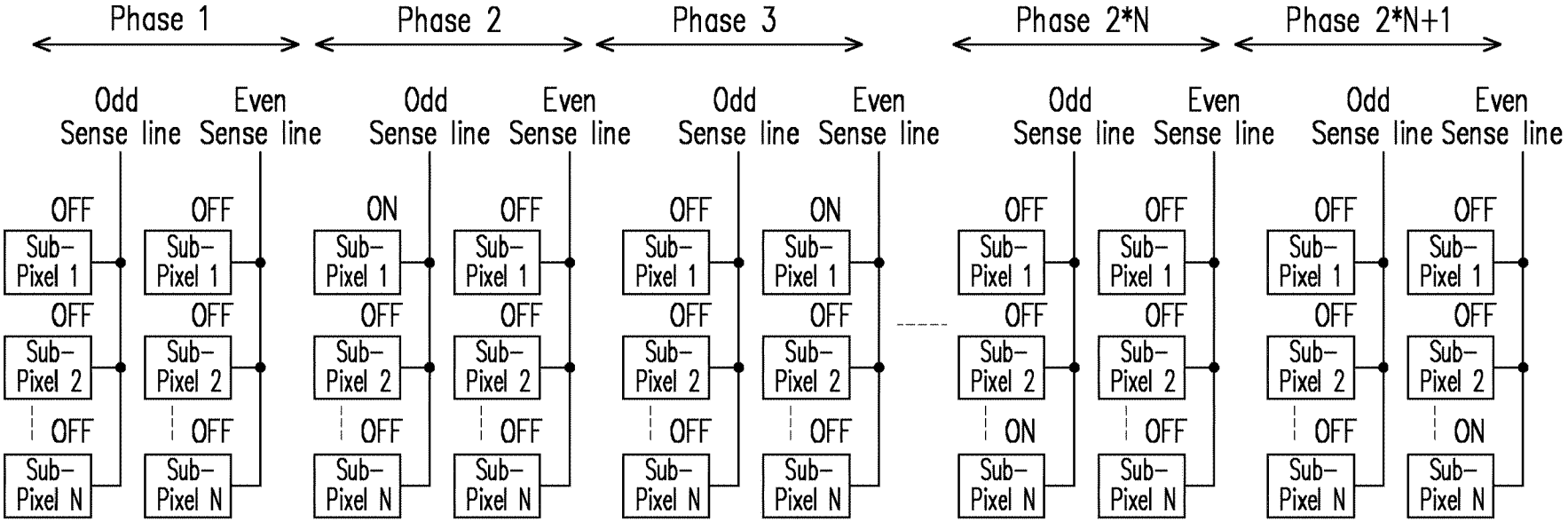
FIG. 6B illustrates states of sub-pixels coupled to sensing lines in a plurality of phases according to an embodiment of the disclosure.

Referring to FIG. 6B, on/off states of sub-pixels coupled to sensing lines in phases in accordance with an embodiment of the disclosure is illustrated. Referring to FIG. 6A and FIG. 6B, in the phase 1, all the sub-pixels coupled to the sensing lines SL_1 (e.g., odd sense line) and SL_2 (e.g., even sense line) are turned off. In this ways, the noises are sensed in the odd sense line and the even sense line during the phase 1. In the phase 2, one of the sub-pixels that are coupled to the odd sense line is turned on while the other ones of the sub-pixels that are coupled to the odd sense line and all sub-pixels that are coupled to the even sense line are turned off. In this way, the signal I_ODD_1 (shown in FIG. 6A) is obtained. The on/off of the sub-pixels in other phases shown in FIG. 6B may be deduced by analogy.

Figure 7A:
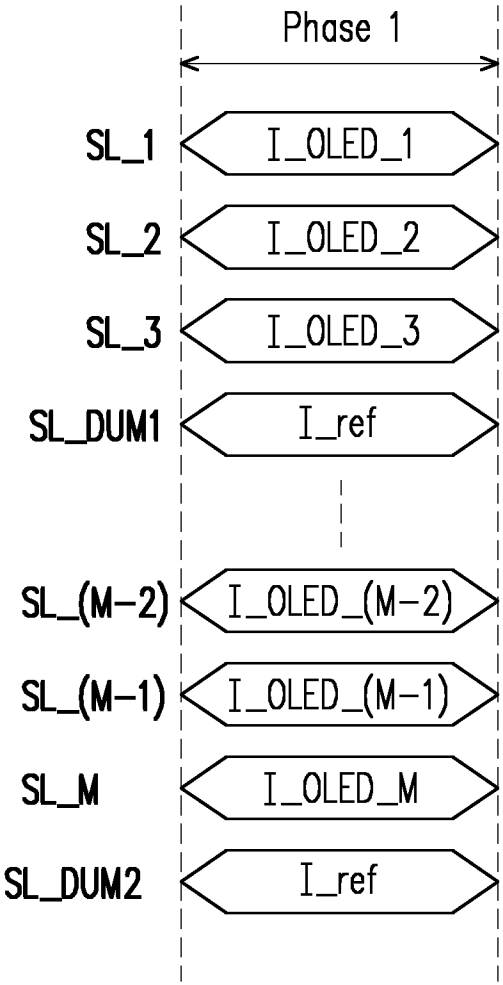
FIG. 7A illustrates signals sensed from sensing lines in one phase according to an embodiment of the disclosure.

Referring to FIG. 7A, signals sensed from sensing lines SL_1 to SL_M, SL_DUM1 and SL_DUM2 in phase 1 in accordance to an embodiment of the disclosure is illustrated. The sensing lines SL_DUM1 and SL_DUM2 are considered as dummy sensing lines that do not couple to any of the pixels; and each of the sensing lines SL_1 to SL_M are real sensing lines that are coupled to a plurality of pixels. The sensing lines SL_1 to SL_M are configured to sense the pixels coupled to the sensing lines SL_1 to SL_M to generate the currents I_OLED_1 to I_OLED_M. The dummy sensing lines SL_DUM1 and SL_DUM2 are configured to sense the noises (e.g., leaking currents and noise currents) existed in the sensing lines. Once the currents I_OLED_1 to I_OLED_M and the noises are sensed through the sensing lines SL_1 to SL_M and the dummy sensing lines SL_DUM1 and SL_DUM2, the noises that are superimposed to the signal sensed from the pixel could be removed. With the dummy sensing lines SL_DUM1 and SL_DUM2, a plurality of signals from a plurality of sensing lines SL_1 to SL_M may be simultaneous sensed in the phase 1, and thus, the noise reduction operation may be performed quickly and efficiently.

Figure 7B:
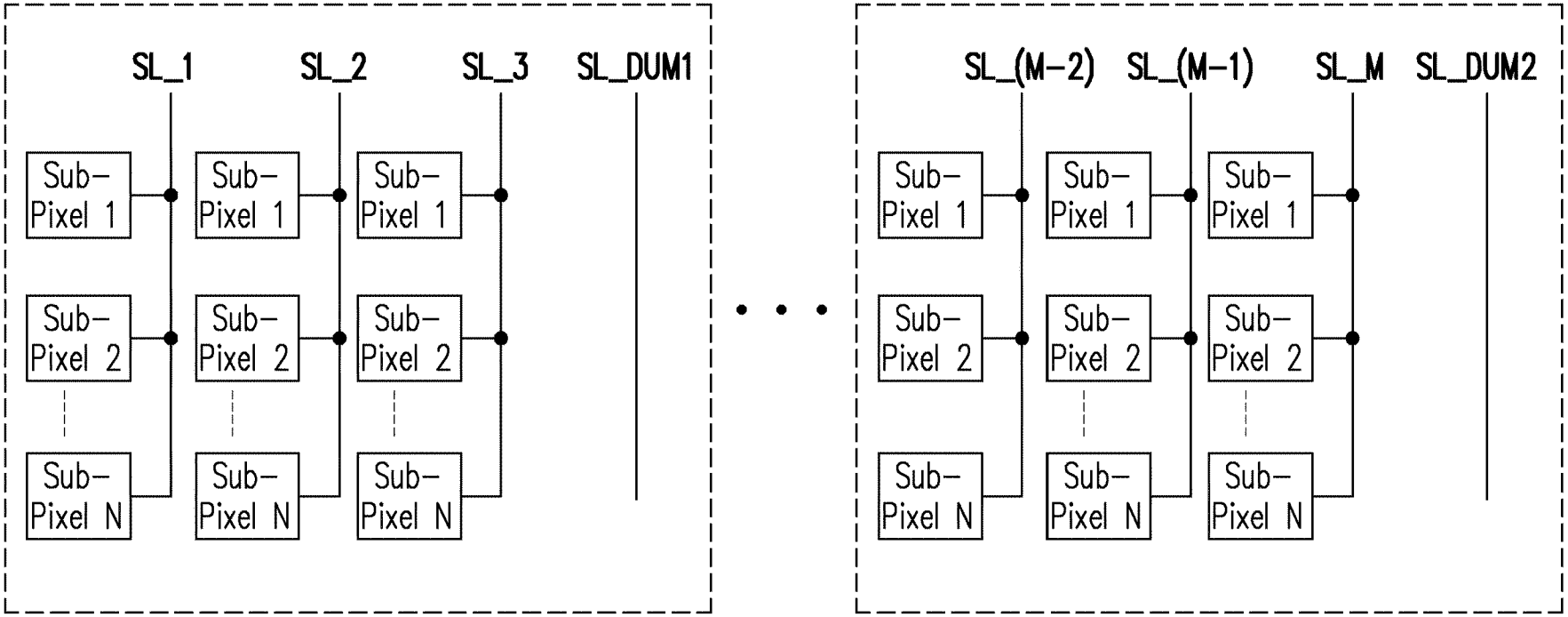
FIG. 7B is a schematic diagram illustrating a display apparatus with dummy sensing lines according to an embodiment of the disclosure.

Referring to FIG. 7B, a diagram of a display apparatus with dummy sensing lines in accordance with an embodiment of the disclosure is illustrated. As shown in FIG. 7B, dummy sensing lines SL_DUM1 and SL_DUM2 are not coupled to any pixel and the dummy sensing lines SL_DUM1 and SL_DUM2 are configured to sense noises existed in the sensing lines of the display apparatus. A number of dummy sensing lines SL_DUM1 and SL_DUM2 and positions of the dummy sensing lines SL_DUM1 and SL_DUM2 are determined according to designed needs. In some embodiments, one dummy sensing line is disposed for each n real sensing lines, where n is an integer number.

Figure 8:
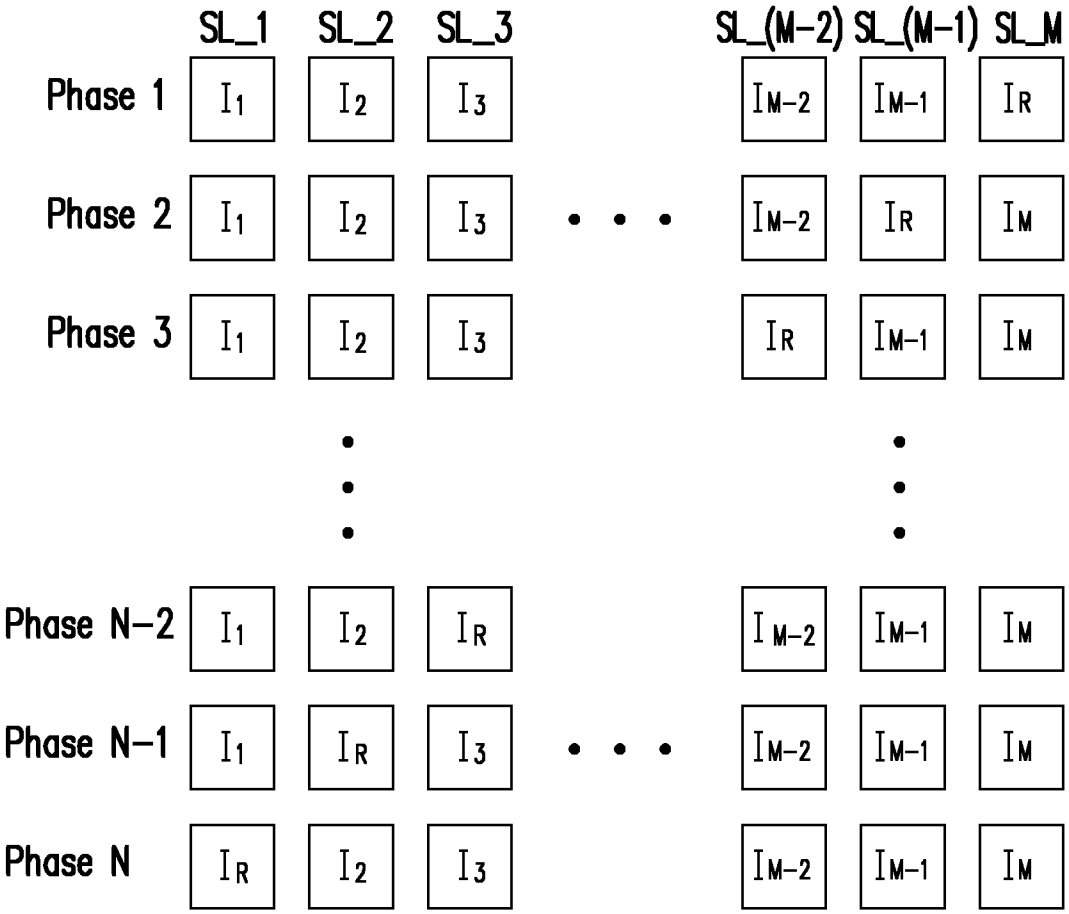
FIG. 8 is a schematic diagram illustrating the signals sensed from a plurality of sensing lines in a plurality of phases according to an embodiment of the disclosure.

Referring to FIG. 8, signals sensed from M sensing lines in N phases in accordance with an embodiment of the disclosure are illustrated, where M and N are integer numbers. In each of the phases from phase 1 to phase N, M−1 sensing lines among the M sensing lines are used to sense pixel currents being supperimposed by noises while the remaining one of the M sensing lines is used to sense noises. For example, in phase 1, the sensing lines SL_1 to SL_(M−1) are used to sense the pixel currents $I_1$ to $I_{M-1}$ of pixels coupled to the sensing lines SL_1 to SL_(M−1), and the sensing line SL_M is used to sense the noises which are indicated by the reference current $I_R$ in FIG. 8. The reference current $I_R$ in FIG. 8 is similar to the reference I_ref as described in FIG. 3 to FIG. 4B. It should be noted that all pixels coupled to the sensing line SL_M is turned off during the phase 1 to sense the noises existed in the sensing line SL_M. Similarly, during the phase N, the sensing lines SL_2 to SL_M are used to sense the pixel currents $I_2$ to $I_M$ of pixels coupled to the sensing lines SL_2 to SL_M, and the sensing line SL_1 is used to sense noises which are indicated by the reference current $I_R$. From the noises and the pixel currents sensed from the sensing lines SL_1 to SL_M, the noises that supperimposed to the pixel currents may be removed to output the denoised pixel currents. In some embodiments, the noises that superimposed to the pixel currents may be removed according to the embodiments described in FIG. 3 to FIG. 6B. Since a plurality of pixel currents could be sensed within one phase, the noises may be removed quickly.

In some embodiments of the disclosure, an averaging operation may be performed to the pixel currents sensed from a specific sensing line in a plurality of phases to generate an average pixel current of the specific sensing line. For example, an averaging operation are performed to the currents I1 sensed from the sensing line SL_1 in phase 1 to phase N to generate an average pixel current of the currents I1. Similarly, an averaging operation may be performed to the pixel currents sensed from other sensing lines in a plurality of phases to generate average pixel currents. In this way, the pixel currents of the pixels are sensed more accurately. It should be noted that the averaging operation is mentioned herein as an example only, other methods may be used to utilize the benefits of pixel currents sensed in a plurality of phases.

Figure 9:
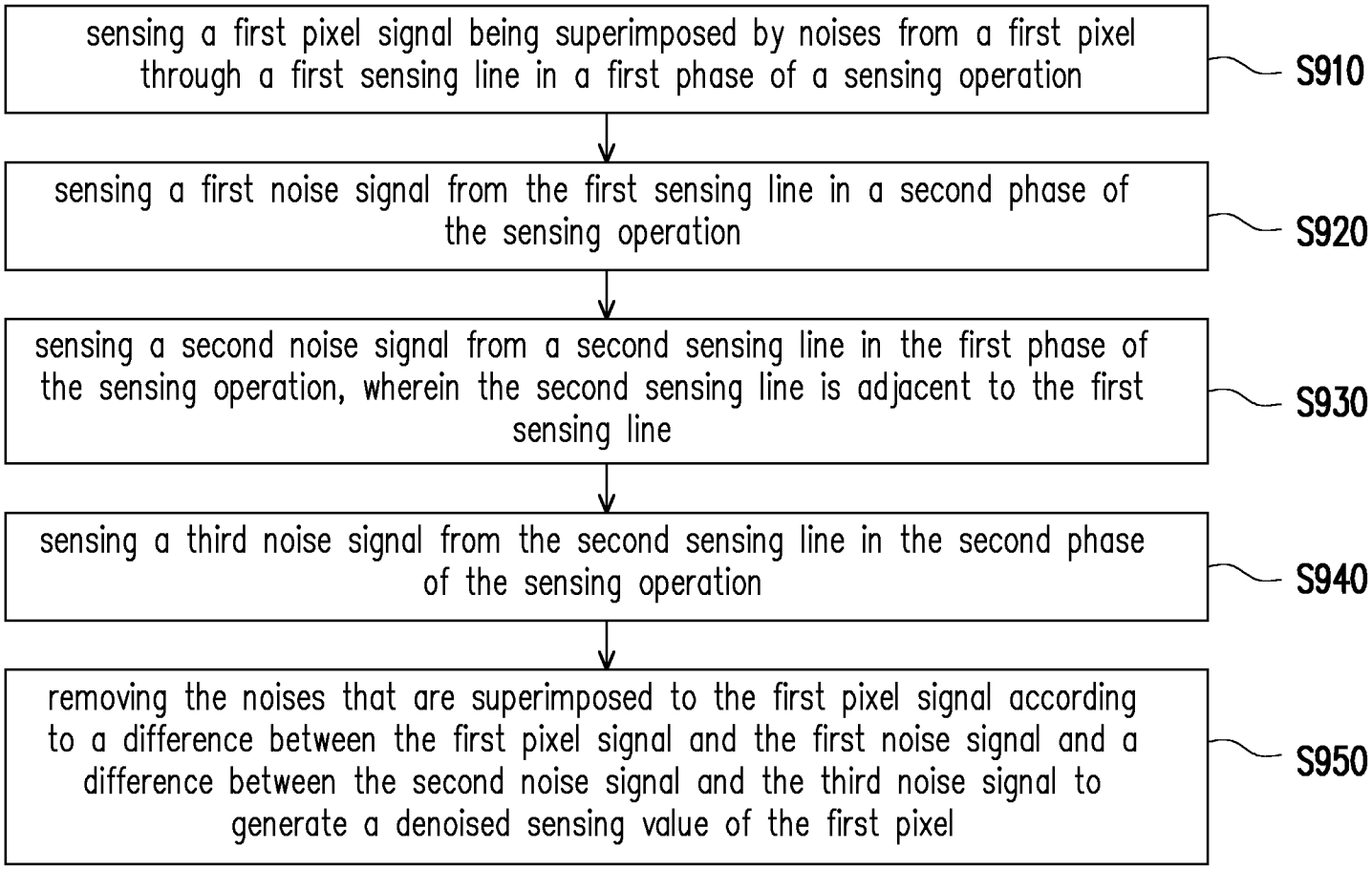
FIG. 9 is a flowchart illustrating a method for noise reduction according to an embodiment of the disclosure.

Referring to FIG. 9, a method for noise reduction in accordance with an embodiment of the disclosure is illustrated. In step S910, a first pixel signal being superimposed by noises is sensed from a first pixel through a first sensing line in a first phase of a sensing operation. In step S920, a first noise signal is sensed from the first sensing line in a second phase of the sensing operation. In steps S930, a second noise signal is sensed from a second sensing line in the first phase of the sensing operation, wherein the second sensing line is adjacent to the first sensing line. In step S940, a third noise signal is sensed from the second sensing line in the second phase of the sensing operation. In step S950, the noises that are superimposed to the first pixel signal are removed according to a difference between the first pixel signal and the first noise signal and a difference between the second noise signal and the third noise signal to generate a denoised sensing value of the first pixel.

Figure 10:
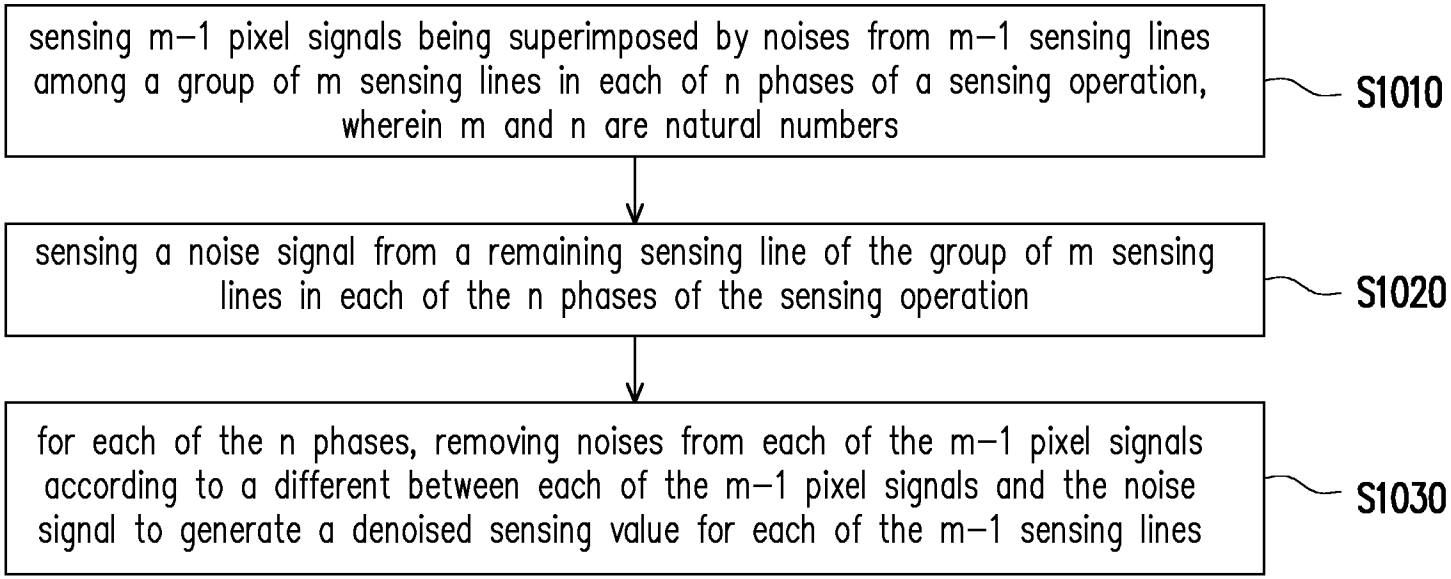
FIG. 10 is a flowchart illustrating a method for noise reduction according to an embodiment of the disclosure.

Referring to FIG. 10, a method for noise reduction according to an embodiment of the disclosure. In step S1010, m-1 pixel signals being superimposed by noises are sensed from m-1 sensing lines among a group of m sensing lines in each of n phases of a sensing operation, wherein m and n are natural numbers. In step S1020, a noise signal from a remaining sensing line of the group of m sensing lines is sensed in each of the n phases of the sensing operation. In step S1030, for each of the n phases, noises from each of the m-1 pixel signals are removed according to a different between each of the m-1 pixel signals and the noise signal to generate a denoised sensing value for each of the m-1 sensing lines From the above embodiments, in a first phase of a sensing operation, a pixel current being superimposed with noises from a first sensing line and noises from a second sensing line are sensed. In a second phase of a sensing operation, noises from both of the first sensing line and the second sensing line are sensed. The noises that are supposed to the pixel current are removed to obtain a denoised pixel current by performing an operation (e.g., subtraction operation) to the sensed pixel current and the noises in the first phase and the second phase. In some embodiments, a plurality of pixel currents are sensed during one phase of the sensing operation, thereby improving the processing speed of the sensing and sensing operations. Furthermore, a plurality of pixel currents that are sensed from one specific sensing line in a plurality of phases may be used to generate an average pixel current. As such, an accuracy of the sensing operation is improved.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A method for noise reduction, comprising:

sensing a first pixel signal being superimposed by noises from a first pixel rough a first sensing line in a first phase of a sensing operation;

sensing a first noise signal from the first sensing line in a second phase of the sensing operation, sensing a second noise signal from a second sensing line in the first phase of the sensing operation;

sensing a third noise signal from the second sensing line in the second phase of the sensing operation; and suppressing the noises that are superimposed to the first pixel signal according to a difference between the first pixel signal and the first noise signal and a difference between the second noise signal and the third noise signal to generate a denoised sensing value of the first pixel.

2. The method of claim 1, wherein suppressing the noises that are superimposed to the first pixel signal according to the difference between the first pixel signal and the first noise signal and the difference between the second noise signal and the third noise signal comprising:

subtracting the first noise signal from the first pixel signal to generate the difference between the first pixel signal and the first noise signal;

subtracting the third noise signal from the second noise signal to generate the difference between the second noise signal and the third noise signal; and subtracting the difference between the second noise signal and the third noise signal from the difference between the first pixel signal and the first noise signal to generate the denoised sensing value of the first pixel.

3. The method of claim 2, further comprising:

sensing a second pixel signal being superimposed by noises from a second pixel through the second sensing line in a third phase of the sensing operation; and sensing a fourth noise signal from the first sensing line in the third phase of the sensing operation; and suppressing the noises that are superimposed to the second pixel signal according to a difference between the second pixel signal and the fourth noise signal and the difference between the third noise signal and the second noise signal to generate a denoised sensing value of the second pixel.

4. The method of claim 3, wherein suppressing the noises that are superimposed to the second pixel signal according to the difference between the second pixel signal and the fourth noise signal and the difference between the second noise signal and the third noise signal to generate the denoised sensing value of the second pixel comprises:

subtracting the fourth noise signal from the second pixel signal to generate the difference between the second pixel signal and the fourth noise signal;

subtracting the second noise signal from the third noise signal to generate the difference between the third noise signal and the second noise signal; and subtracting the difference between the third noise signal and the second noise signal from the difference between the second pixel signal and the fourth noise signal to generate the denoised sensing value of the second pixel.

5. The method of claim 3, wherein the second noise signal and the third noise signal are sensed from the second sensing line when pixels being coupled to the second sensing line are turned off; and the first noise signal and the fourth noise signal are sensed from the first sensing line when pixels being coupled to the first sensing line are turned off.

6. The method of claim 3, further comprising:

sensing a plurality of third pixel signals being superimposed by noises from a plurality of third pixels through the first sensing line in a plurality of fourth phases of the sensing operation;

sensing a plurality of fifth noise signals from the second sensing line in the fourth phases, wherein each of the fifth noise signals is corresponded to one of the third pixel signals; and suppressing the noises that are superimposed to each of the third pixel signals according to a difference between the third pixel signal and the corresponding fifth noise signal and a difference between the second noise signal and the third noise signal.

7. The method of claim 3, further comprising:

sensing a plurality of fourth pixel signals being superimposed by noises from a plurality of fourth pixels through the second sensing line in a plurality of fifth phases of the sensing operation;

sensing a plurality of sixth noise signals from the first sensing line in the plurality of fifth phases, wherein each of the sixth noise signals is corresponded to one of the fourth pixel signals; and suppressing the noises that are superimposed to each of the fourth pixel signals according to a difference between the fourth pixel signal and the corresponding sixth noise signal and a difference between the third noise signal and the second noise signal.

8. A display apparatus, comprising:

a sensing circuit, configured to:

sense a first pixel signal being superimposed by noises from a first pixel through a first sensing line in a first phase of a sensing operation;

sense a first noise signal from the first sensing line in a second phase of the sensing operation;

sense a second noise signal from a second sensing line in the first phase of the sensing operation; and sense a third noise signal from the second sensing line in the second phase of the sensing operation; and a control device, configured to suppress noises that are superimposed to the first pixel signal according to a difference between the first pixel signal and the first noise signal and a difference between the second noise signal and the third noise signal to generate a denoised sensing value of the first pixel.

9. The display apparatus of claim 8, wherein the control device comprises a timing controller, a system on chip or a driver integrated circuit of the display apparatus.

10. The display apparatus of claim 8, wherein the control device is configured to:

subtract the first noise signal from the first pixel signal to generate the difference between the first pixel signal and the first noise signal;

subtract the third noise signal from the second noise signal to generate the difference between the second noise signal and the third noise signal; and subtract the difference between the second noise signal and the third noise signal from the difference between the first pixel signal and the first noise signal to generate the denoised sensing value of the first pixel.

11. The display apparatus of claim 8, wherein the sensing circuit is further configured to:

sensing a second pixel signal being superimposed by noises from a second pixel through the second sensing line in a third phase of the sensing operation; and sensing a fourth noise signal from the first sensing line in the third phase of the sensing operation, and the control device is further configured to suppress the noises that are superimposed to the second pixel signal according to a difference between the second pixel signal and the fourth noise signal and the difference between the third noise signal and the second noise signal to generate a denoised sensing value of the second pixel.

12. The display apparatus of claim 11, wherein the control device is configured to:

subtract the fourth noise signal from the second pixel signal to generate the difference between the second pixel signal and the fourth noise signal;

subtract the second noise signal from the third noise signal to generate a difference between the third noise signal and the second noise signal; and subtract the difference between the second noise signal and the third noise signal from the difference between the second pixel signal and the fourth noise signal to generate the denoised sensing value of the second pixel.

13. The display apparatus of claim 8, wherein the sensing circuit is further configured to:

sense a plurality of third pixel signals being superimposed by noises from a plurality of third pixels through the first sensing line in a plurality of fourth phases of the sensing operation; and sense a plurality of fifth noise signals from the second sensing line in the fourth phases, wherein each of the fifth noise signals is corresponded to one of the third pixel signals, and the control device is further configured to suppress the noises that are superimposed to each of the third pixel signals according to a difference between the third pixel signal and the corresponding fifth noise signal and a difference between the second noise signal and the third noise signal.

14. The display apparatus of claim 8, wherein the sensing circuit is further configured to:

sense a plurality of fourth pixel signals being superimposed by noises from a plurality of fourth pixels through the second sensing line in a plurality of fifth phases of the sensing operation; and sense a plurality of sixth noise signals from the first sensing line in the plurality of fifth phases, wherein each of the sixth noise signals is corresponded to one of the fourth pixel signals, and the control device is further configured to suppress the noises that are superimposed to each of the fourth pixel signals according to a difference between the fourth pixel signal and the corresponding sixth noise signal and a difference between the third noise signal and the second noise signal.

* * * * *